United States Patent [19]

Niederer et al.

[11] Patent Number: 4,949,440

[45] Date of Patent: Aug. 21, 1990

[54] METHOD AND APPARATUS FOR TWISTING YARN, AND PRODUCT

[75] Inventors: Kurt W. Niederer, Charlotte; Edward L. Hand, Belmont, both of N.C.; Edwin R. Grose, Clover, S.C.

[73] Assignee: Belmont Textile Machinery Co., Inc., Belmont, N.C.

[21] Appl. No.: 413,779

[22] Filed: Sep. 28, 1989

Related U.S. Application Data

[63] Continuation-in-part of Ser. No. 311,138, Feb. 15, 1989, Pat. No. 4,899,426, which is a continuation-in-part of Ser. No. 226,297, Jul. 29, 1988, Pat. No. 4,934,134.

[51] Int. Cl.[5] ..... D02G 1/16; D02G 3/24; D02J 1/06

[52] U.S. Cl. ..... 28/271; 57/908

[58] Field of Search ..... 28/252, 258, 271, 273, 28/274, 283; 57/333, 350, 908

[56] References Cited

U.S. PATENT DOCUMENTS 3,805,344 4/1974 Bartnicki et al. ..... 28/252
4,085,487 4/1978 Barch et al. ..... 28/252

FOREIGN PATENT DOCUMENTS 0633948 11/1978 U.S.S.R. ..... 28/271

*Primary Examiner*—Werner H. Schroeder
*Assistant Examiner*—Bradley Kurtz DeSandro
*Attorney, Agent, or Firm*—W. Thad Adams, III.

[57] ABSTRACT

An apparatus for processing yarn, comprising yarn supply packages for supplying a yarn. First and second feed rolls and a take-up roll are provided for delivering the plied yarn from the supply package onto a take-up package. An air-jet is positioned between the first and second feed rolls for inserting short, spaced-apart entangled segments into the plied yarn as the plied yarn moves past the air-jet at a predetermined speed. The air-jet comprises an enclosure having a yarn entrance and a yarn exit and a nozzle for directing a stream of pressurized air into the enclosure and against the plied yarn while the plied yarn is moving through the enclosure. The nozzle moves past the enclosure at substantially the same surface speed as the yarn is moving through the enclosure whereby the stream of pressurized air impacts a short, discrete segment of yarn while the segment of yarn is within the enclosure.

28 Claims, 10 Drawing Sheets

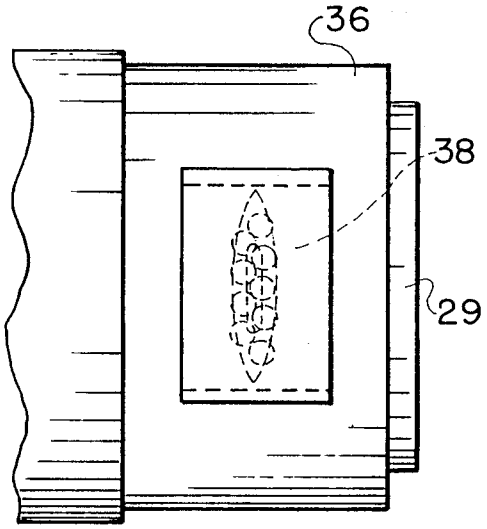
FIG. 5
FIG. 4
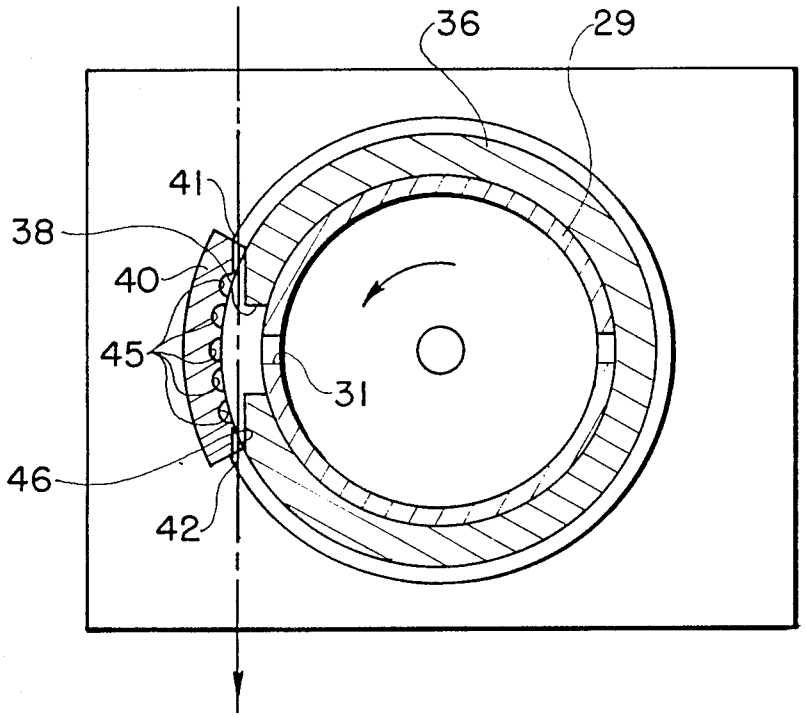

METHOD AND APPARATUS FOR TWISTING YARN, AND PRODUCT

This is a Continuation-In-Part of Ser. No. 07/311,138, filed 2/15/89, now U.S. Pat. No. 4,899,426, issued 2/13/90, which is a Continuation-In-Part of Ser. No. 07/226,297, field 7/29/88, now U.S. Pat. No. 494,134, issued 6/19/90.

TECHNICAL FIELD AND BACKGROUND OF THE INVENTION

This invention relates to an apparatus and method for twisting yarn in a particular way to achieve a particularly lively yarn at a high rate of speed. The yarn has characteristics which permit the yarn to be varied further by post-treating. The yarn is processed in a unique way by moving the yarn along a given distance in unison with an air jet twister or some other device which alters the physical characteristics of the yarn. Expressed another way, relative motion between a yarn and a yarn processing device is interrupted momentarily, so in effect, the yarn can be acted on as if it were stationary. Of course, in general, the yarn is actually moving.

A splice occurs which releases part of the twisting torque in the yarn strand allowing the yarn bundle to twist partially.

The characteristics of the yarn processed according to the method and apparatus of this invention are particularly adapted for production of tufted pile carpet. The yarn exhibits superior bulk, liveliness and a randomness which increases resistance to visible color variations resulting from dyeing variations and prevents color-patterning so called moirÉ-patterning occurring with regularly twisted plied yarn.

SUMMARY OF THE INVENTION

Therefore, it is an object of the invention to provide an apparatus which permits two yarns to be spliced together along spaced-apart segments.

It is another object of the invention to provide an apparatus which produces a yarn of superior liveliness and capable of post-treatment to further vary the characteristics of the yarn.

It is another object of the invention to provide a method of splicing two yarns together at intervals while causing twist migration along the length of the yarn.

It is another object of the invention to provide a method of producing a yarn which exhibits characteristics favorable for the use of the yarn in carpet tufting operations.

It is another object of the invention to provide a yarn which exhibits characteristics favorable for the use of the yarn in, for example, carpet tufting operations.

These and other objects of the present invention are achieved in the preferred embodiments disclosed below by providing an apparatus for processing yarn, comprising a yarn supply package means for supplying a plied yarn comprised of first and second plied yarn strands wherein at least one of the yarn strands comprises either a spun yarn strand or a twisted yarn strand. First and second feed rolls and a take-up roll are provided for delivering the plied yarn from the supply package means onto a take-up package. An air-jet is positioned between the first and second feed rolls for inserting short, spaced-apart entangled segments into the plied yarn as the plied yarn moves past the air-jet at a predetermined speed. The air-jet comprises an enclosure having a yarn entrance and a yarn exit, a nozzle means for directing a stream of pressurized air into the enclosure and against the plied yarn while the plied yarn is moving through the enclosure, and means for moving the nozzle means through the enclosure at substantially the same surface speed as the yarn is moving through the enclosure whereby the stream of pressurized air impacts a short, discrete segment of yarn while the segment of yarn is within the enclosure.

According to one preferred embodiment of the invention, the nozzle means comprises a rotating roll having radially-extending air jet nozzles formed in spaced-apart relation around the periphery of the roll.

According to another preferred embodiment of the invention, wherein the rotating roll is circular and the air-jet includes confuser means positioned in the enclosure for confusing the stream of pressurized air within the enclosure and thereby varying the effect of the stream of air on the plied yarn.

Preferably, the enclosure includes a cover positioned over and in spaced-part relation to the rotating roll and defining a yarn path therebetween.

According to one preferred embodiment of the invention, the cover defines an inner wall segment curved to correspond to the curve of the rotating roll and defining therebetween a generally straight-line yarn path.

Preferably, the confuser means comprises the shape of the inner wall segment of the cover defining variations for directing the air in many different directions.

According to one preferred embodiment of the invention, the variations in the shape of the inner wall segment of the cover comprises a plurality of preferably circular dimples having overlapping tangents.

According to one preferred embodiment of the invention, the dimples comprise concavities in the inner wall of the cover.

According to one preferred embodiment of the invention the cover comprises a one-directional escape channel, thereby giving the stream of air a uni-directional rotation.

According to one preferred embodiment of the invention, an air-jet is provided for inserting short, spaced-apart entangled segments into a plied yarn as the plied yarn moves past the air-jet at a predetermined speed. The air-jet comprises an enclosure having a yarn entrance and a yarn exit, nozzle means for directing a stream of pressurized air into the enclosure and against the plied yarn while the plied yarn is moving through the enclosure, and means for moving the nozzle means through the enclosure at substantially the same surface speed as the yarn is moving through the enclosure whereby the stream of pressurized air impacts a short, discrete segment of yarn while the segment of yarn is within the enclosure.

An embodiment of the method according to the invention comprises the steps of moving a plied yarn through an enclosure having a yarn entrance and a yarn exit, directing a stream of pressurized air into the enclosure and against the plied yarn while the plied yarn is moving through the enclosure, moving the stream of pressurized air through the enclosure at substantially the same surface speed as the yarn is moving through the enclosure whereby the stream of pressurized air impacts a short, discrete segment of yarn while the segment of yarn is within the enclosure and releases some of the torque of the spun yarn resulting in twist to migrate upstream and downstream from the impacted segment of yarn, and confusing the stream of pressurized air within the enclosure and thereby varying the effect of the stream of air on the plied yarn.

An embodiment of the method according to the invention comprises the steps of moving a plied yarn through an enclosure having a yarn entrance and a yarn exit, directing a stream of pressurized air into the enclosure and against the plied yarn while the plied yarn is moving through the enclosure, moving the stream of pressurized air through the enclosure at substantially the same surface speed as the yarn is moving through the enclosure whereby the stream of pressurized air impacts a short, discrete segment of yarn while the segment of yarn is within the enclosure and releases some of the torque of the spun yarn resulting in twist to migrate upstream and downstream from the impacted segment of yarn, and give the stream of pressurized air within the enclosure a unidirectional rotation.

According to one preferred embodiment of the invention, the method includes the step of passing the plied yarn between a cover and a spaced-apart rotating roll having a plurality of air-jet nozzles therein and defining a yarn path therebetween.

According to another preferred embodiment of the invention, the cover defines an inner wall segment curved to correspond to the curve of the rotating roll.

According to another preferred embodiment of the invention, the method includes the step of passing the plied yarn through the yarn path and past a cover having variations in the shape of the inner wall segment of the cover.

According to yet another preferred embodiment of the invention, the variations in the shape of the inner wall segment of the cover comprises a plurality of preferably circular dimples having overlapping tangents.

According to one preferred embodiment of the invention, the dimples comprise concavities in the inner wall of the cover.

According to one preferred embodiment of the invention, the cover having a one-directional escape channel.

According to one preferred embodiment of the yarn according to the present invention, randomly entangled, plied yarn consists essentially of a first yarn strand and a second yarn strand wherein at least one of the first yarn strands or the second yarn strands is either twisted or spun, and further wherein the first and second yarn strands are plied by twist in opposite direction of the yarn twist.

According to another preferred embodiment of the invention, the first and second yarn strands are twisted.

According to yet another preferred embodiment of the invention, the first and second yarn strands are twisted with the opposite direction of twist.

Preferably, the spliced zones comprise between 5 and 40 percent of the length of the yarn.

According to one preferred embodiment of the invention, the first and second yarn strands in the spliced zones are locked together by entangled fibers of both first and second yarn strands.

According to one preferred embodiment of the invention, the twist in the spliced zones is torqued.

According to yet another preferred embodiment of the invention, the twist in the spliced zones is stabilized.

According to another preferred embodiment of yarn according to the invention, a randomly entangled, plied yarn consists essentially of a first yarn strand and a second yarn strand wherein the first yarn strands and the second yarn strands are twisted, and further wherein the first and second yarn strands are plied by twist in an opposite direction in spaced-part splices defining splicing zones along the length of the yarn and by twist in a second direction between the splicing zones.

According to another preferred embodiment of the invention one or more continuous filaments are entangled together at selectable intervals.

According to one preferred embodiment of the invention, an apparatus for processing yarn comprises a yarn supply package means for supplying a plied yarn comprised of first and second plied yarn strands wherein at least one of the yarn strands comprises either a spun yarn strand or a twisted yarn strand. First and second feed rolls and a take-up roll deliver the plied yarn from the supply package means onto a take-up package at a predetermined take-up speed. Yarn processing means act on the yarn for altering a predetermined physical characteristic of the yarn. Relative motion varying means momentarily vary relative movement between the yarn and the yarn processing means, during which time the yarn is acted on in a manner different than when the yarn is traveling at its take-up speed past a stationary yarn processing station.

Preferably, the yarn processing means comprises an air jet twister.

According to one preferred embodiment of the invention, the yarn processing means comprises an air jet twister and the relative movement varying means comprises a support for moving the air jet twister at substantially the same surface speed as the yarn.

According to another preferred embodiment of the invention, the yarn processing means comprises an air jet and the relative movement varying means comprises a pair of eccentrically-mounted rotating rolls. The rolls are mounted on opposing sides of the yarn path to grip the yarn and convey the yarn at a predetermined surface speed greater or less than the take-up speed of the yarn when the rolls rotate into contact with each other on each eccentric revolution and to release the grip on the yarn when the rolls rotate out of contact with each other on each eccentric revolution.

According to yet another preferred embodiment of the invention, the yarn movement varying means includes means for momentarily interrupting all relative movement between the yarn and the yarn processing means.

According to yet another preferred embodiment of the invention, the yarn movement varying means to generate a pulsating varying yarn speed.

BRIEF DESCRIPTION OF THE DRAWINGS

Some of the objects of the invention have been set forth above. Other objects and advantages of the invention will appear as the invention proceeds when taken in conjunction with the following, drawings, in which:

FIG. 4 is a cross-section of the air-jet taken substantially along lines B—B of FIG. 3;

FIG. 5 is a fragmentary view of the air-jet showing the cover in place over the air orifice;

DESCRIPTION OF THE PREFERRED EMBODIMENT AND BEST MODE

Figure 1:
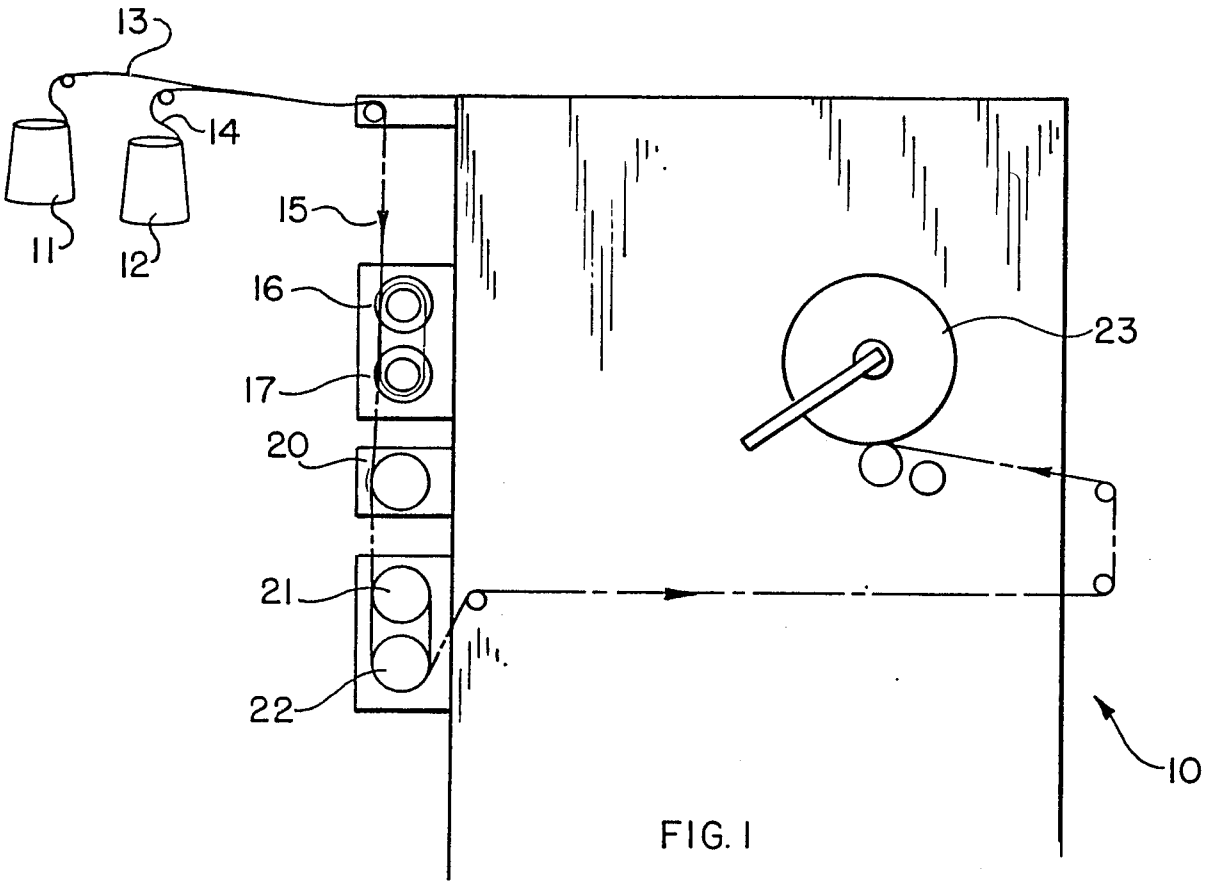
FIG. 1 is a schematic view of the yarn flow path through a winder apparatus according to a preferred embodiment of the invention.

Referring now specifically to the drawings, a winder having an air-jet twister thereon according to one embodiment of the present invention is illustrated in FIG. 1 and shown generally at reference numeral 10. Winder 10 includes a creel (not shown) which contains supply packages of yarn 11 and 12 which supply a pair of parallel yarn strands 13 and 14 which form a plied yarn 15. Yarn 15 is passed over a pair of conical feed rolls 16 and 17 which apply a positive surface speed to the yarn 15. Yarn 15 then passes over a yarn processing device such as an air-jet twister 20 according to the present invention. Yarn 15 exits air-jet twister 20 and passes over a pair of overfeed rolls 21 and 22. Yarn 15 is then wound onto a take-up package 23 at a predetermined take-up speed.

Figure 2:
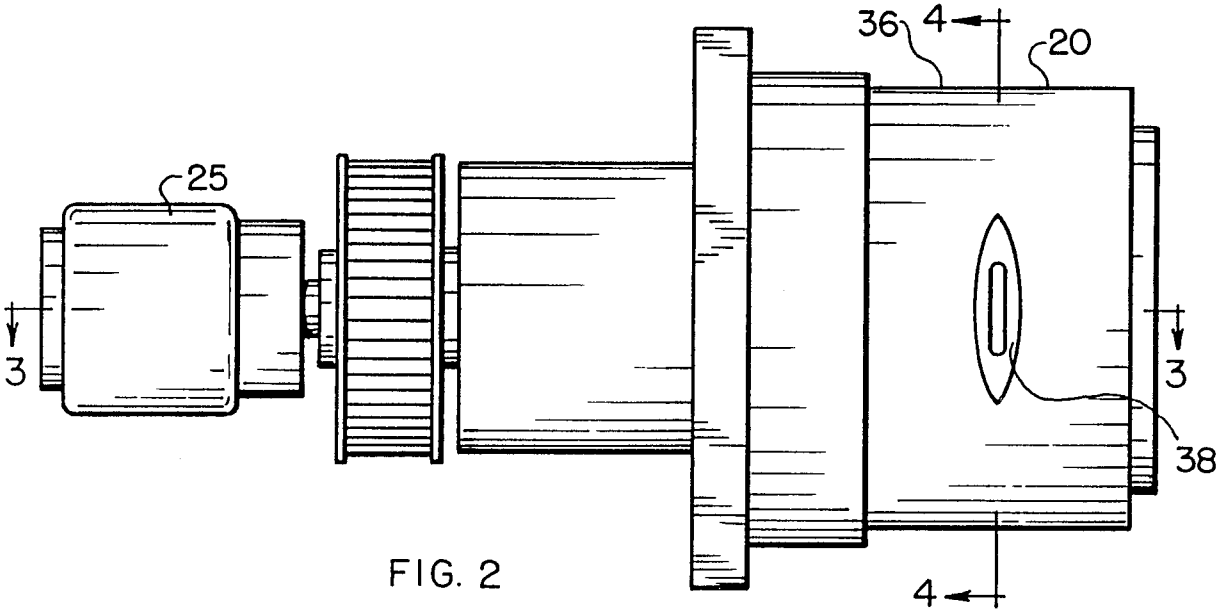
FIG. 2 is a front elevation of an air-jet according to the present invention.
Figure 3:
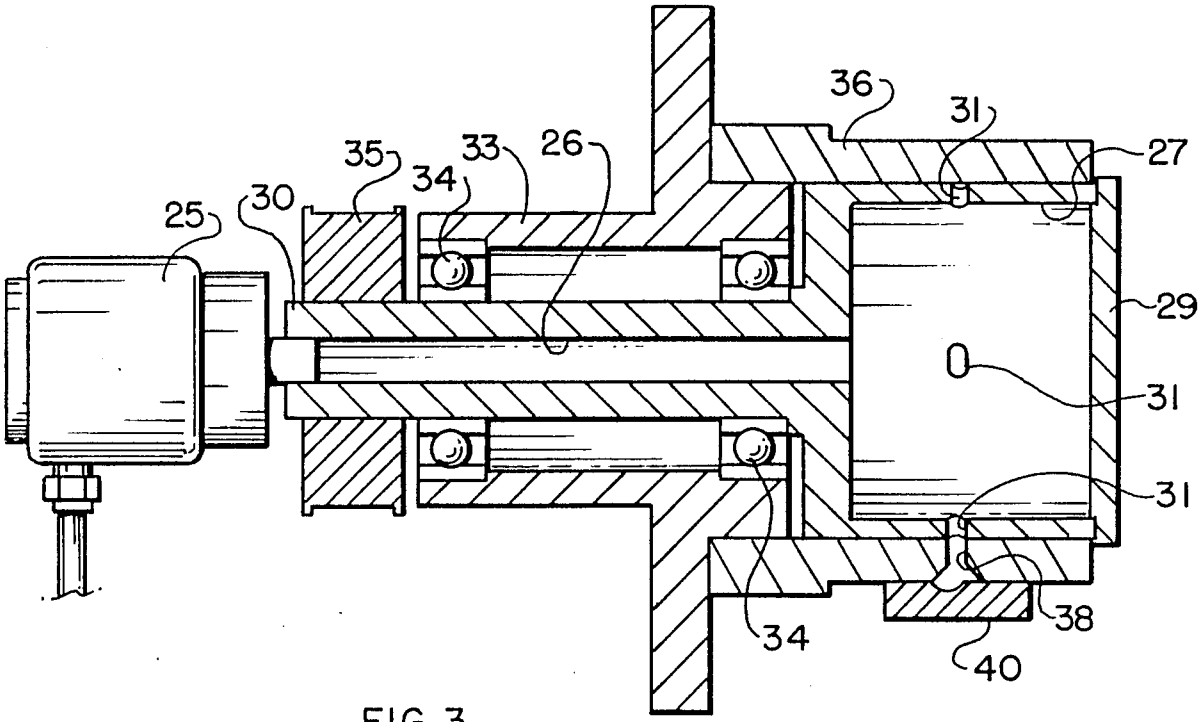
FIG. 3 is a cross-section of the air-jet taken substantially along lines A—A of FIG. 3.

Air-jet twister 20 is illustrated in more detail in FIGS. 2 and 3. Compressed air is delivered through a rotary union 25 and an air conduit 26 to an air chamber 27. Air chamber 27 is formed within an air roll 29 mounted on the end of a spindle 30 through which air conduit 26 communicates. Air roll 29 is provided with at least one, but preferably a plurality, for example 4, 6 or 8, of air nozzles 31 which communicate with the axial peripheral surface of air roll 29 and air chamber 27 to deliver pressurized air.

Spindle 30 is mounted for rotation in a bearing housing 33 and rotates on high speed roller bearings 34. A drive pulley 35 mounted on one end of spindle 30 rotates air roll 29 by means of a drive belt, such as a timing belt. Air roll 29 is enclosed by a hood 36. As is best shown in FIG. 2, hood 36 has an elongated opening 38 in line with the plurality of air nozzles 31.

Opening 38 is in line with the yarn path so that the yarn substantially bisects opening 38 as it passes. The B-B section line in FIG. 2 illustrates the position of the yarn path. As air roll 29 rotates, successive nozzles 31 pass behind opening 38, permitting pressurized air to exit.

As is apparent, the interval between successive blasts of air through opening 38 depends upon the number and spacing of nozzles 31 and the speed of rotation of air roll 29. The spacing of nozzles 31 need not be symmetrical around the periphery of air roll 29. The speed of rotation of the air roll 29 can be varied resulting in slower or faster tangential speed than the yarn speed. This tangential speed can vary between 75% and 130% of the yarn speed. An electronic randomizer of the type as used for winders can provide the drive through an electric motor to the air roll 29. This speed variation of the air roll 29 results in length variation between the spliced spaces of the combined yarn.

Figure 7:
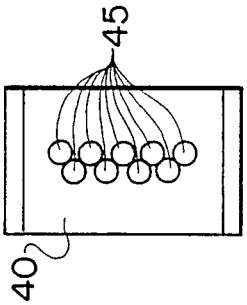
FIG. 7 is a front view of the cover illustrating the overlapping tangents of the dimples in the back side thereof.
Figure 6:
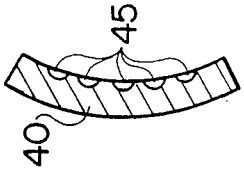
FIG. 6 is a vertical cross-section of the cover shown in FIG. 5.

As is shown in FIGS. 3 and 4, opening 38 is covered by a cover 40. Cover 40 is generally arcuate in shape and defines top and a bottom openings 41, 42 which serve as a yarn entrance and exit, respectively. Thus, the yarn passes between hood 36 and cover 40 through top and bottom openings and directly in front of opening 38. As is shown in FIG. 4, cover 40 has a plurality of concave dimples 45 in its inner wall 46. See, also, FIG. 6. As is shown in FIG. 7, the dimples 45 have overlapping tangents and, as is shown in FIG. 5, are positioned directly over opening 38. The dimples 45 collectively comprise a confuser which directs the blast of air in an essentially infinite number of directions back against the yarn positioned between it and opening 38. This randomized movement of air completely randomizes the individual yarn fibers while they are untwisted. This phenomenon is described in further detail below.

In a commercial embodiment of winder 10, several stations as described above are arrayed along the length of the winder frame, with each station being fed by yarn packages contained in the creel.

Figure 11:
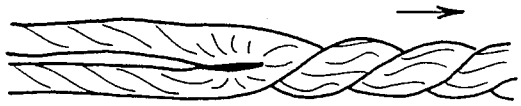
FIGS. 8–11 are sequential views showing creation of the yarn according to a preferred embodiment of the invention according to the method according to a preferred embodiment of the invention.
Figure 10:
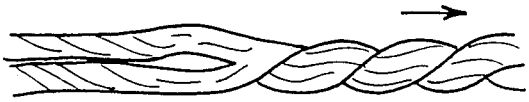
Figure 9:
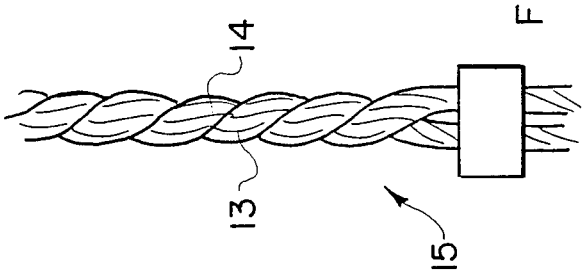
Figure 8:
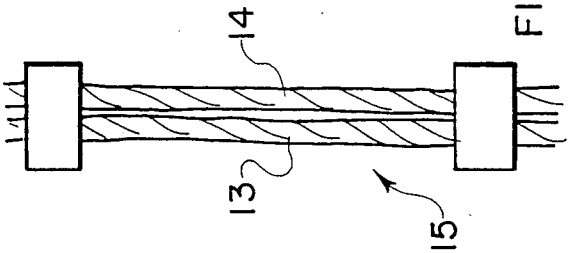
Figure 12:
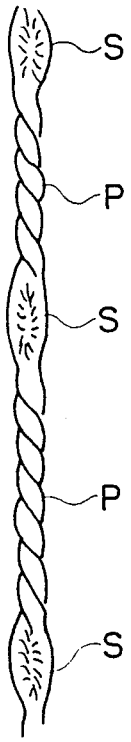
FIG. 12 is a view of untwisted, continous filament yarns entangled according to a preferred embodiment of the invention.
Figure 13:
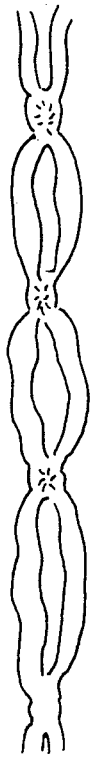
FIG. 13 is a view of a length of the yarn according to a preferred embodiment of the invention.

Referring now to FIGS. 8–13, the physical effects of the method on a plied yarn carried out on the apparatus described above is illustrated. It is well known that a spun yarn, as does any elastic material, tries to untwist due to the imparted twisting torque. FIG. 8 shows the two parallel yarn strands of the yarn. Assume both ends are held in a clamp to restrain the yarns from untwisting. FIG. 9 shows how the two yarn strands untwist in "S" direction when the clamp on the top is removed. FIG. 10 shows how the air jet opens up the spun yarns in the first moment of impact and allows the two yarn strands to twist in "S" direction. FIG. 11 shows how in the next instant the air jet entangles the two yarns together. FIG. 12 shows a portion of treated yarn where spliced places "S" alternate with plied yarn portions "P." Depending on the spacing of the splices, the original torque in the yarn and the intensity of the air jet a certain percentage of torque remains in the yarn resulting in an air-twisted yarn which is still "lively," i.e., the torque and the twist are not "set." Alternatively, the twist and torque can be stabilized through post-treatment such as heat-setting. See FIG. 13.

Figure 14:
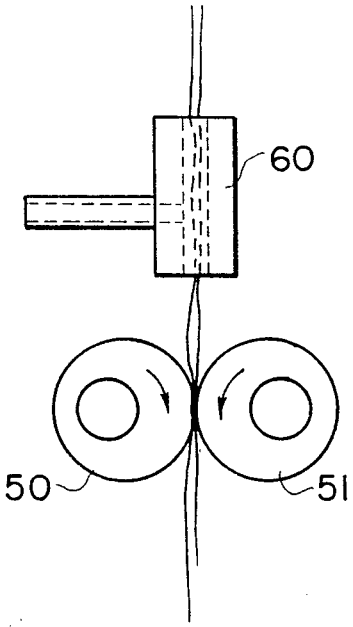
FIGS. 14 and 15 are schematic views of an alternate embodiment of the invention.
Figure 15:
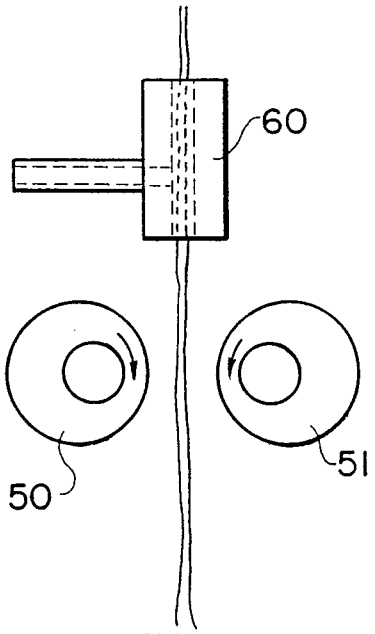

An alternative device for practicing the invention is shown in FIGS. 14 and 15. A pair of eccentric rotating "plucking" rolls 50 and 51 positioned downstream of a stationary air-jet 60 alternately pluck at the yarns. A higher or lower surface speed of the rolls 50 and 51 in relation to the surface speed of the yarns results from the intermittant action of the rolls 50 and 51 on the yarn. If, for example, the rolls 50 and 51 are rotating with a surface speed faster than the yarn speed, the yarn will be momentarily accellerated, and then when the rolls 50 51 release their grip on the yarn, the yarns will momentarily jerk back so that they become practically stationary for a very short period of time. During this short period of time the air jet 60 acts on the yarn in the manner described above with reference to air-jet twister 20. Changes in relative motion permit the air blast to splice the yarn as described above.

Figure 17:
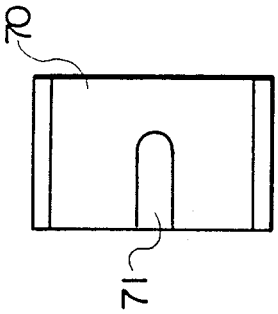
FIG. 17 is a front view of the cover with a cross groove.
Figure 16:
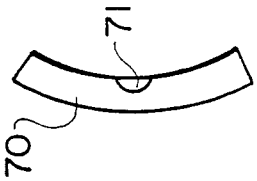
FIG. 16 is a vertical side view of another embodiment of the cover with a cross groove.

FIGS. 16 and 17 show another type of opening cover 70 with a cross groove 71. The one-sided groove 71 allows some of the pressurized jet-air to escape sideways. This develops inside the yarn opening 38 (see FIG. 3) a rotating jet stream in clockwise or counterclockwise direction depending on which side the groove exhausts the air.

As described above, relative motion between the yarns and the air nozzle 31 is an important factor in the practice of the invention. Varying yarn characteristics will result depending on the degree of relative motion. The length and amount of twist in the splice, the spacing between the spliced segments and numerous other characteristics can be varied. The number and degree of variations is so great that experimentation with any given yarn construction is necessary to achieve the desired results.

The following is an example of the type of apparatus on which yarn can be processed as described above:

Yarn Surface Speed: 500 meters/min.

Air Roll: 4 nozzles evenly spaced around 8 cm. roll splice 4-6 cm long.

An apparatus and method for twisting yarn, and a twisted yarn product is described above. Various details of the invention may be changed without departing from its scope. Furthermore, the foregoing description of the preferred embodiment of the invention and the best mode for practicing the invention are provided for the purpose of illustration only and not for the purpose of limitation--the invention being defined by the claims.

We claim:

1. An apparatus for processing yarn, comprising:

(a) a yarn supply package means for supplying a plied yarn comprised of first and second plied yarn strands wherein at least one of said yarn strands comprises either spun yarn strand or a twisted yarn strand;

(b) first and second feed rolls and a take-up roll for delivering said plied yarn from the supply package means onto a take-up package; and (c) an air-jet positioned between said first and second feed rolls for inserting short, spaced-apart entangled segments into the plied yarn as the plied yarn moves past said air-jet at a predetermined speed; said air-jet comprising:

(i) an enclosure having a yarn entrance and a yarn exit;

(ii) nozzle means for directing a stream of pressurized air into said enclosure and against said plied yarn while said plied yarn is moving through said enclosure;

(iii) means for moving said nozzle means through said enclosure at substantially the same surface speed as the yarn is moving through said enclosure whereby said stream of pressurized air impacts a short, discrete segment of yarn while said segment of yarn is within said enclosure.

2. An apparatus for processing yarn according to claim 1, wherein said nozzle means comprises a rotating wheel having radially-extending air jet nozzles formed in spaced-apart relation around the periphery of said wheel.

3. An apparatus for processing yarn according to claim 2, wherein said rotating wheel is circular and said air-jet includes confuser means positioned in said enclosure for confusing said stream of pressurized air within said enclosure and thereby varying the effect of said stream of air on said plied yarn.

4. An apparatus for processing yarn according to claim 3, wherein said enclosure includes a cover positioned over and in spaced-part relation to said rotating wheel and defining a yarn path therebetween.

5. An apparatus for processing yarn according to claim 4, wherein said cover defines an inner wall segment curved to correspond to the curve of said rotating wheel and defining therebetween a generally straight-line yarn path.

6. An apparatus for processing yarn according to claim 5, wherein said confuser means comprises the shape of the inner wall segment of said cover defining variations for directing the air in many different directions.

7. An apparatus for processing yarn according to claim 6, wherein said variations in the shape of the inner wall segment of said cover comprises a plurality of dimples having overlapping tangents.

8. An apparatus for processing yarn according to claim 7, wherein said dimples are circular.

9. An apparatus for processing yarn according to claim 7, wherein said dimples comprise concavities in the inner wall of said cover.

10. An apparatus for processing yarn according to claim 8, wherein said dimples comprise concavities in the inner wall of said cover.

11. An air-jet for inserting short, spaced-apart entangled segments into a plied yarn as the plied yarn moves past said air-jet at a predetermined speed; said air-jet comprising:

(i) an enclosure having a yarn entrance and a yarn exit;

(ii) nozzle means for directing a stream of pressurized air into said enclosure and against said plied yarn while said plied yarn is moving through said enclosure;

(iii) means for moving said nozzle means through said enclosure at substantially the same surface speed as the yarn is moving through said enclosure whereby said stream of pressurized air impacts a short, discrete segment of yarn while said segment of yarn is within said enclosure.

12. An apparatus for processing yarn according to claim 11, wherein said nozzle means comprises a rotating wheel having radially-extending air jets formed in spaced-apart relation around the periphery of said wheel.

13. An apparatus for processing yarn according to claim 12, wherein said rotating wheel is circular and said airjet includes confuser means positioned in said enclosure for confusing said stream of pressurized air within said enclosure and thereby varying the effect of said stream of air on said plied yarn.

14. An apparatus for processing yarn according to claim 13, wherein said enclosure includes a cover positioned over and in spaced-part relation to said rotating wheel and defining a yarn path therebetween.

15. An apparatus for processing yarn according to claim 14, wherein said cover defines an inner wall segment curved to correspond to the curve of said rotating wheel.

16. An apparatus for processing yarn according to claim 15, wherein said confuser means comprises the shape of the inner wall segment of said cover having variations therein to direct the flow of air in many different directions.

17. An apparatus for processing yarn according to claim 16, wherein said variations in the shape of the inner wall segment of said cover comprises a plurality of dimples having overlapping tangents.

18. An apparatus for processing yarn according to claim 17, wherein said dimples are circular.

19. An apparatus for processing yarn according to claim 17, wherein said dimples comprise concavities in the inner wall of said cover.

20. An apparatus for processing yarn according to claim 18, wherein said dimples comprise concavities in the inner wall of said cover.

21. A method of migrating twist in a plied yarn, comprising the steps of:

(i) moving a plied yarn through an enclosure having a yarn entrance and a yarn exit;

(ii) directing a stream of pressurized air into the enclosure and against the plied yarn while the plied yarn is moving through the enclosure;

(iii) moving the stream of pressurized air through the enclosure at substantially the same surface speed as the yarn is moving through the enclosure whereby the stream of pressurized air impacts a short, discrete segment of yarn while the segment of yarn is within the enclosure and forces the twist to migrate upstream and downstream from the impacted segment of yarn; and (iv) confusing the stream of pressurized air within the enclosure and thereby varying the effect of the stream of air on the plied yarn.

22. A method according to claim 21, and including the step of passing the plied yarn between a cover and a spaced-apart rotating wheel having a plurality of air-jet nozzles therein and defining a yarn path therebetween.

23. A method for processing yarn according to claim 22, wherein the cover defines an inner wall segment curved to correspond to the curve of the rotating wheel.

24. A method for processing yarn according to claim 23, and including the step of passing the plied yarn through the yarn path and past a cover having variations in the shape of the inner wall segment of the cover.

25. A method for processing yarn according to claim 24, wherein the variations in the shape of the inner wall segment of the cover comprises a plurality of dimples having overlapping tangents.

26. A method for processing yarn according to claim 25, wherein the dimples are circular.

27. A method for processing yarn according to claim 25, wherein the dimples comprise concavities in the inner wall of the cover.

28. A method for processing yarn according to claim 26, wherein the dimples comprise concavities in the inner wall of the cover.

* * * * *